US011719022B2

(12) United States Patent
Chen

(10) Patent No.: US 11,719,022 B2
(45) Date of Patent: Aug. 8, 2023

(54) DOOR BOLT LOCK STRUCTURE

(71) Applicant: Jeff Chen, Chiayi (TW)

(72) Inventor: Jeff Chen, Chiayi (TW)

( * ) Notice: Subject to any disclaimer, the term of this patent is extended or adjusted under 35 U.S.C. 154(b) by 80 days.

(21) Appl. No.: 17/515,693

(22) Filed: Nov. 1, 2021

(65) Prior Publication Data

US 2023/0132852 A1 May 4, 2023

(51) Int. Cl.

| | |
|---|---|
| ***E05B 47/00*** | (2006.01) |
| ***E05B 55/00*** | (2006.01) |
| ***E05B 63/08*** | (2006.01) |
| ***E05B 63/00*** | (2006.01) |
| ***E05B 47/02*** | (2006.01) |

(52) U.S. Cl.

CPC ..... *E05B 47/0012* (2013.01); *E05B 47/026* (2013.01); *E05B 55/005* (2013.01); *E05B 63/0056* (2013.01); *E05B 63/08* (2013.01)

(58) Field of Classification Search

CPC .... E05B 47/00; E05B 47/0012; E05B 47/026; E05B 55/00; E05B 55/005; E05B 63/00; E05B 63/0056; E05B 63/006; E05B 63/08; E05B 63/10

USPC ..... 292/137

See application file for complete search history.

(56) References Cited

U.S. PATENT DOCUMENTS

| | | | | |
|---|---|---|---|---|
| 5,364,138 | A * | 11/1994 | Dietrich | E05B 63/06 292/1.5 |
| 2007/0052245 | A1* | 3/2007 | Bodily | E05C 1/163 292/1.5 |
| 2010/0307207 | A1* | 12/2010 | Vogel | E05B 55/005 292/1.5 |
| 2019/0345737 | A1* | 11/2019 | Ramakrishna | E05B 63/06 |

* cited by examiner

*Primary Examiner* — Nathan Cumar

(74) *Attorney, Agent, or Firm* — Alan D. Kamrath; Karin L. Williams; Mayer & Williams PC

(57) ABSTRACT

A door bolt lock structure contains: a casing, a drive element, a slide plate, and a head. The casing includes a cavity and a locking orifice. The drive element is accommodated in the cavity and includes a lock cylinder and a control lever. The slide plate slidably is received in the drive element and includes a holder, a groove, a free segment, a first locating orifice, and a second locating orifice. The head includes a trench and a threaded orifice, such that the threaded orifice is selectively aligned with the first locating orifice or the second locating orifice of the slide plate, and a second screw element is inserted through the locking orifice of the casing, the first locating orifice or the second locating orifice, and the threaded orifice of the head so as to adjustably move the head with respect to the slide plate.

5 Claims, 6 Drawing Sheets

DOOR BOLT LOCK STRUCTURE

FIELD OF THE INVENTION

The present invention relates to a door bolt lock structure by which the head extends in different distances based on using requirements by selectively aligning the threaded orifice of the head with the first locating orifice or the second locating orifice of the slide plate easily.

BACKGROUND OF THE INVENTION

A door frame contains a groove defined thereon and configured to receive a head a conventional door bolt lock, thus locking a door.

However, the head cannot extend in different distances based on using requirements.

The present invention has arisen to mitigate and/or obviate the afore-described disadvantages.

SUMMARY OF THE INVENTION

The primary aspect of the present invention is to provide a door bolt lock structure by which the head extends in different distances based on using requirements by selectively aligning the threaded orifice of the head with the first locating orifice or the second locating orifice of the slide plate easily.

To achieve above-mentioned aspect, a door bolt lock structure provided by the present invention contains: a casing, a drive element, a slide plate, and a head.

The casing includes a cavity defined therein, and the case includes a locking orifice formed on a predetermined position of a first end thereof The drive element is accommodated in the cavity of the casing, the drive element includes a lock cylinder mounted on an end thereof, and the drive element includes a control lever extending from a side of the lock cylinder.

The slide plate is slidably received in the drive element and includes a holder formed on a first end of the slide plate, a groove defined in the holder so that the control lever of the drive element slides in the groove, a free segment extending from a second end of the slide plate, a first locating orifice defined on a side of the free segment adjacent to the defining portion, and a second locating orifice defined on the side of the free segment away from the defining portion and spaced from the first locating orifice.

The head includes a trench configured to receive the free segment of the slide plate, a threaded orifice defined on a top of the head and communicating with the trench. The threaded orifice is selectively aligned with the first locating orifice or the second locating orifice of the slide plate, and a second screw element is inserted through the locking orifice of the casing, the first locating orifice or the second locating orifice, and the threaded orifice of the head so as to adjustably move the head with respect to the slide plate.

DETAILED DESCRIPTION OF THE PREFERRED EMBODIMENTS

Figure 1:
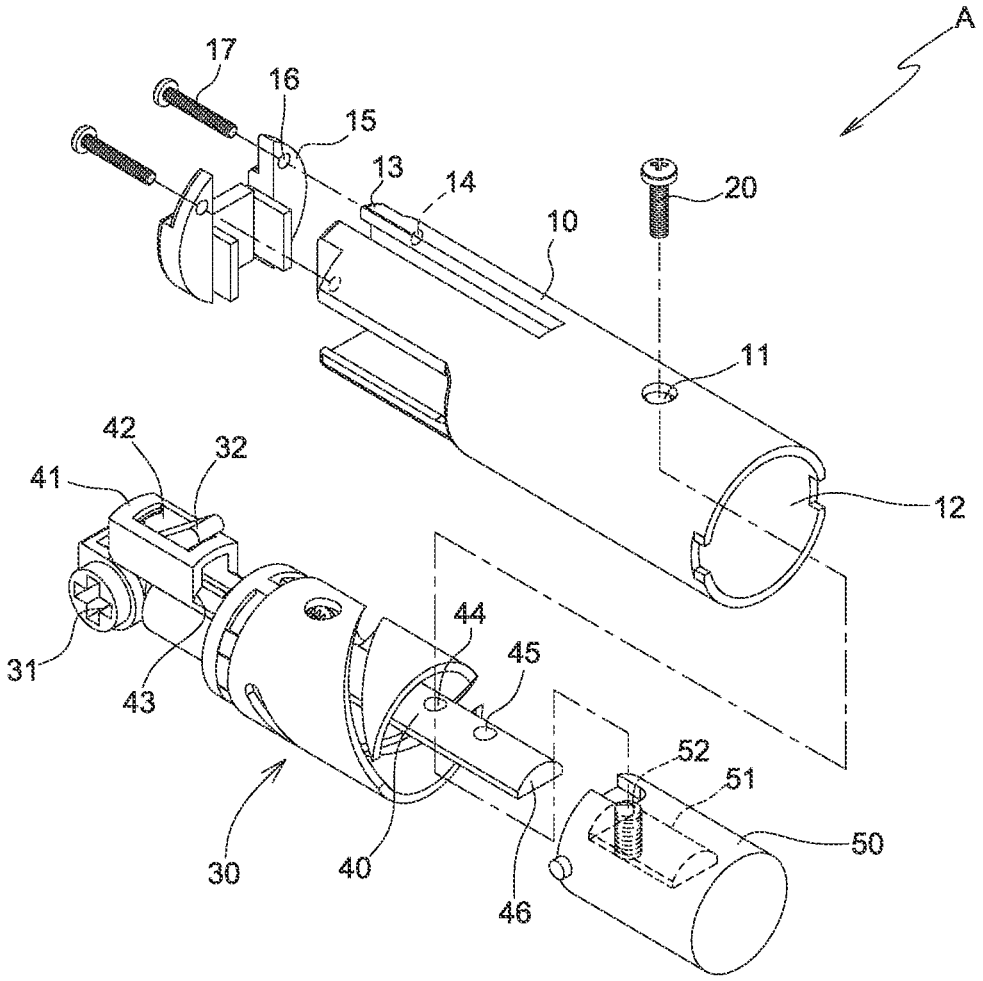
FIG. 1 is a perspective view showing the exploded components of a door bolt lock structure according to a preferred embodiment of the present invention.

With reference to FIGS. 1-6, a door bolt lock structure according to a preferred embodiment of the present invention comprises a body A, and the body A includes:

a casing 10, a cavity 12 defined in the casing 10, a locking orifice 11 formed on a predetermined position of a first end of the casing 10, a connection segment 13 formed on a second end of the casing 10, multiple apertures 14 defined on multiple predetermined positions of the connection segment 13, a cap 15 covered on the connection segment 13, multiple fixing portions 16 formed on the cap 15 and corresponding to the multiple apertures 14, multiple first screw elements 17 inserted through the multiple apertures 14 and the multiple fixing portions 16 so as to connect the cap 15 with the connection segment 13 of the casing 10; wherein the casing 10 further includes a stop sheet 60, and the stop sheet 60 has a through orifice 61 passing through a center of the stop sheet 60 and aligning with the cavity 12 of the casing 10;

a drive element 30 accommodated in the cavity 12 of the casing 10, the drive element 30 including a lock cylinder 31 mounted on an end of the drive element 30, and the drive element 30 including a control lever 32 extending from a side of the lock cylinder 31;

a slide plate 40 slidably received in the drive element 30 and including a holder 41 formed on a first end of the slide plate 40, a defining portion 43 formed opposite to the holder 21, a groove 42 defined in the holder 41 so that the control lever 32 of the drive element 30 slides in the groove 42, a free segment 46 extending from a second end of the slide plate 40, a first locating orifice 44 defined on a side of the free segment 46 adjacent to the defining portion 43, and a second locating orifice 45 defined on the side of the free segment 46 away from the defining portion 43 and spaced from the first locating orifice 44; and a head 50 including a trench 51 configured to receive the free segment 46 of the slide plate 40, a threaded orifice 52 defined on a top of the head 50 and communicating with the trench 51, wherein the threaded orifice 52 is selectively aligned with the first locating orifice 44 or the second locating orifice 45 of the slide plate 40, and a second screw element 20 is inserted through the locking orifice 11 of the casing 10, the first locating orifice 44 or the second locating orifice 45, and the threaded orifice 52 of the head 50 so as to adjustably move the head 50 with respect to the slide plate 40.

Figure 2:
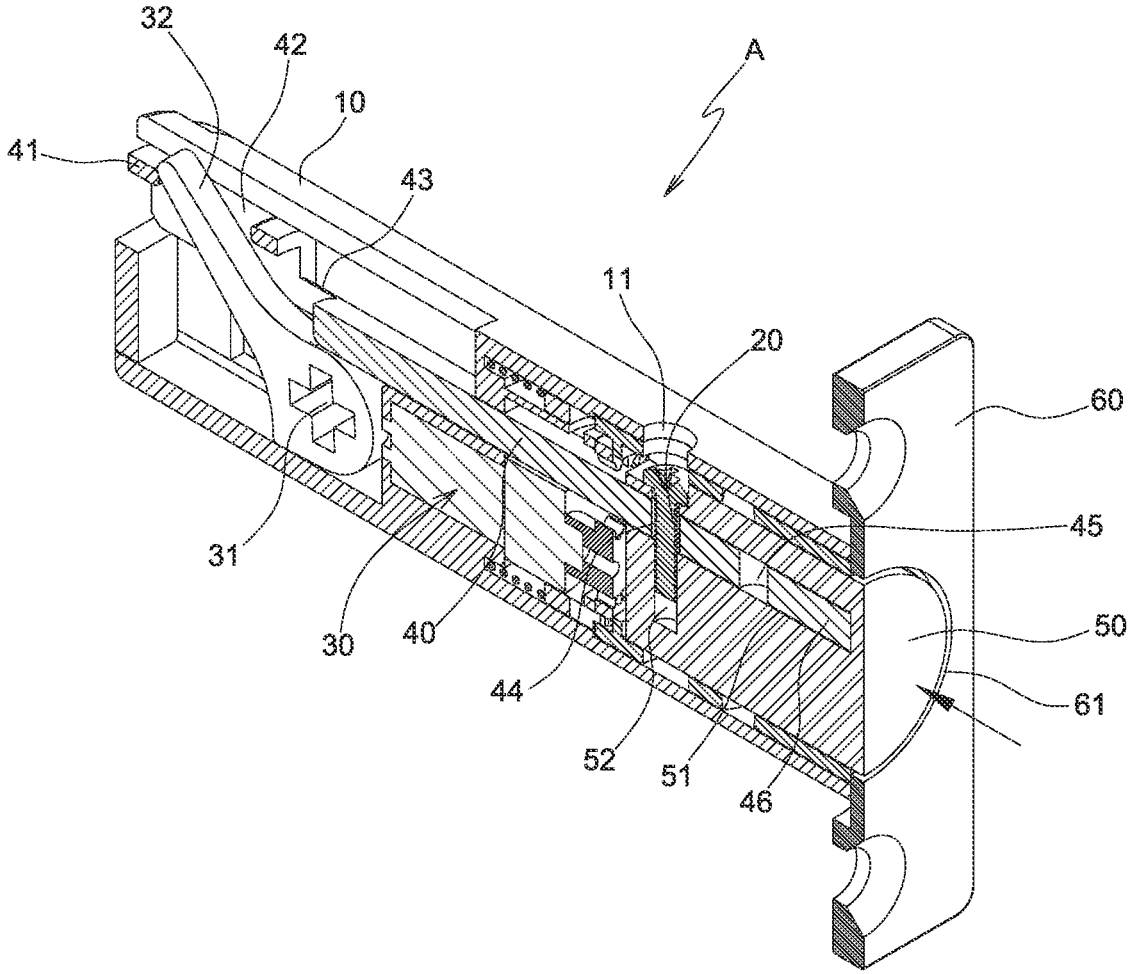
FIG. 2 is a cross-sectional perspective view showing the assembly of the door bolt lock structure according to the preferred embodiment of the present invention.
Figure 3:
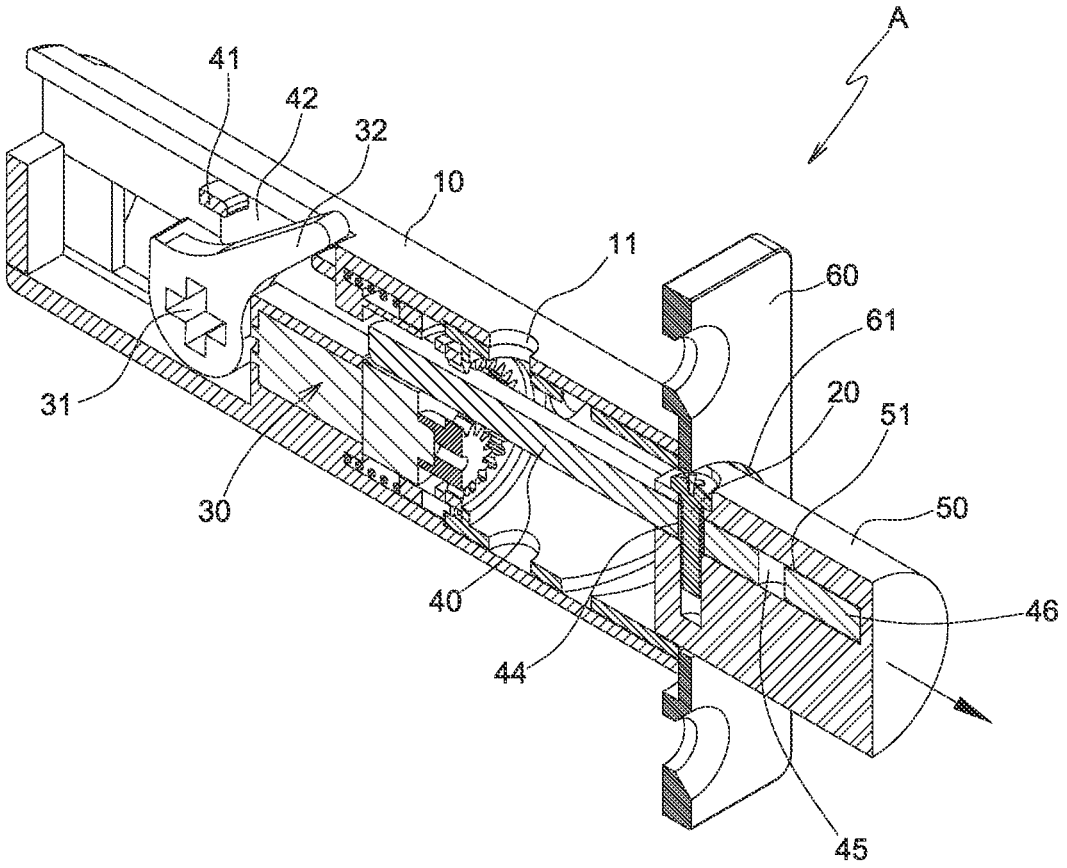
FIG. 3 is another cross-sectional perspective view showing the assembly of the door bolt lock structure according to the preferred embodiment of the present invention.
Figure 4:
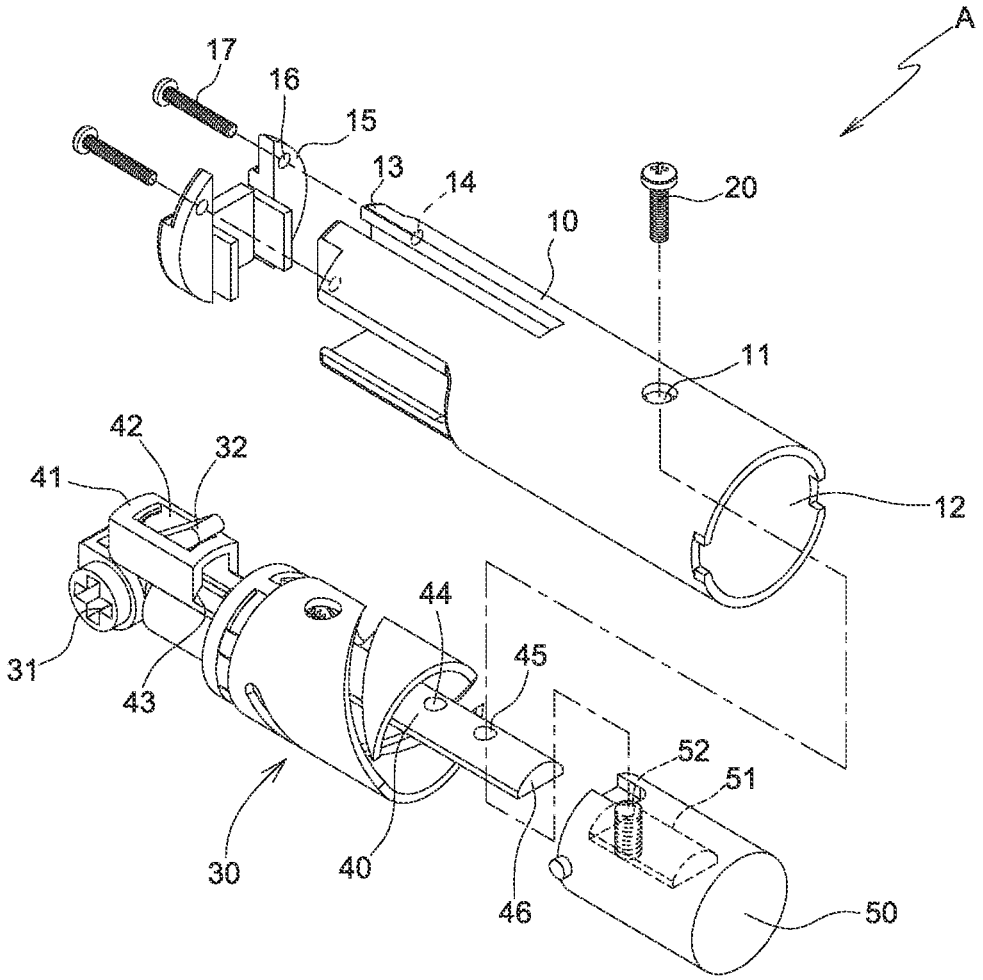
FIG. 4 is another perspective view showing the exploded components of the door bolt lock structure according to the preferred embodiment of the present invention.
Figure 5:
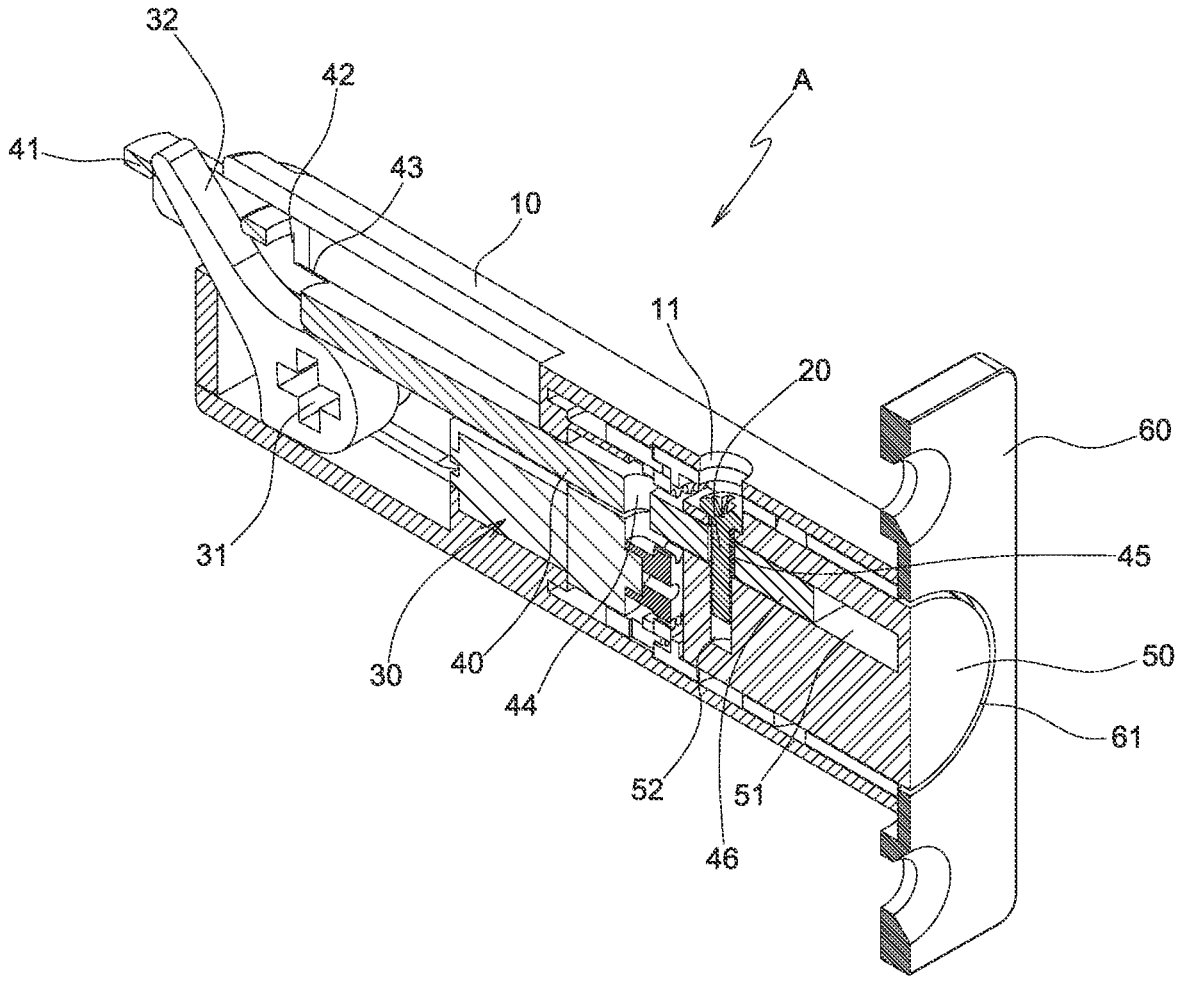
FIG. 5 is a cross-sectional perspective view showing the operation of the door bolt lock structure according to the preferred embodiment of the present invention.
Figure 6:
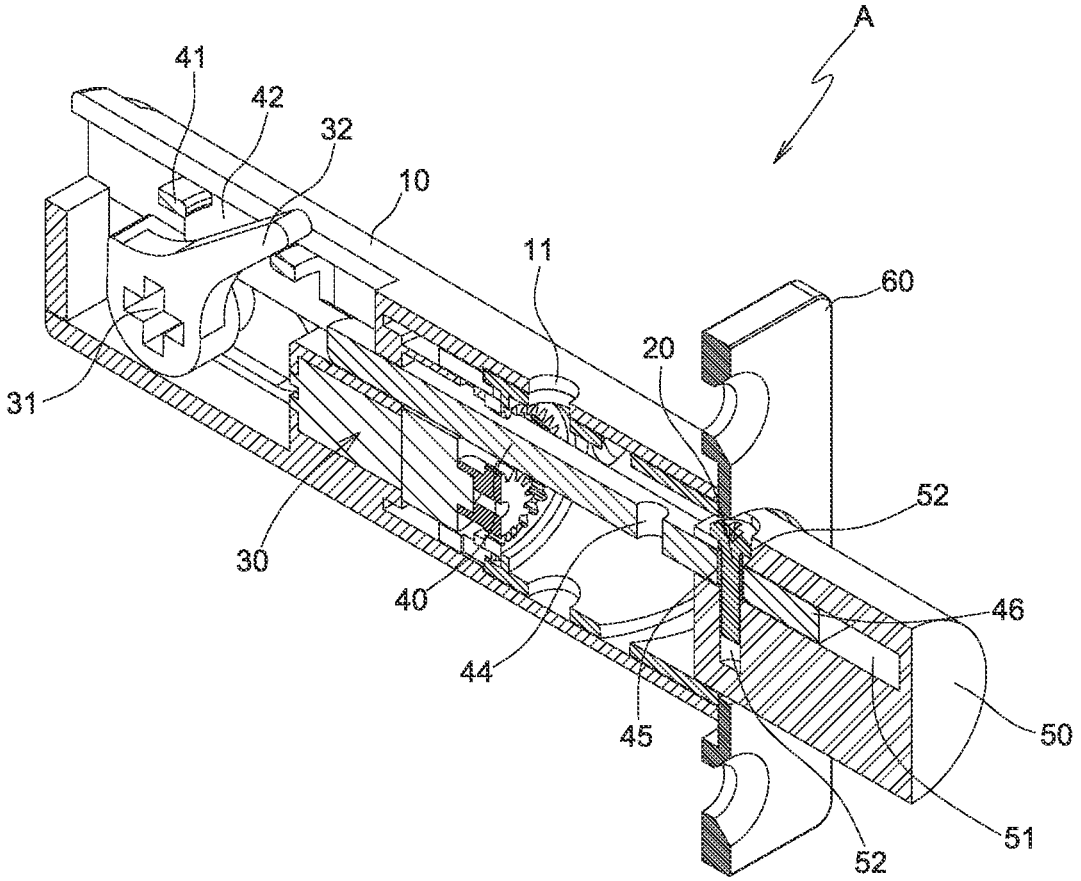
FIG. 6 is another cross-sectional perspective view showing the operation of the door bolt lock structure according to the preferred embodiment of the present invention.

Referring to FIGS. 1-3, the threaded orifice 52 of the head 50 is connected with the first locating orifice 44 of the slide plate 40 so that the head 50 extends in a first distance. As shown in FIGS. 4-6, the threaded orifice 52 of the head 50 is connected with the second locating orifice 45 of the slide plate 40 so that the head 50 extends in a second distance, wherein the first distance is less than the second distance.

Accordingly, the head 50 extends in different distances based on using requirements by selectively aligning the threaded orifice 52 of the head 50 with the first locating orifice 44 or the second locating orifice 45 of the slide plate 40 easily.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A door bolt lock structure comprising:

a casing, a cavity defined in the casing, and a locking orifice formed on a predetermined position of a first end of the casing;

a drive element accommodated in the cavity of the casing, the drive element including a lock cylinder mounted on an end of the drive element, and the drive element including a control lever extending from a side of the lock cylinder;

a slide plate slidably received in the drive element and including a holder formed on a first end of the slide plate, a groove defined in the holder so that the control lever of the drive element slides in the groove, a free segment extending from a second end of the slide plate, a first locating orifice defined on a side of the free segment adjacent to the defining portion, and a second locating orifice defined on the side of the free segment away from the defining portion; and a head including a trench configured to receive the free segment of the slide plate, a threaded orifice defined on a top of the head and communicating with the trench, wherein the threaded orifice is selectively aligned with the first locating orifice or the second locating orifice of the slide plate, and a second screw element is inserted through the locking orifice of the casing, the first locating orifice or the second locating orifice, and the threaded orifice of the head so as to adjustably move the head with respect to the slide plate.

2. The door bolt lock structure as claimed in claim 1, wherein the casing includes a connection segment formed on a second end thereof, multiple apertures defined on multiple predetermined positions of the connection segment, a cap covered on the connection segment, multiple fixing portions formed on the cap and corresponding to the multiple apertures, and multiple first screw elements inserted through the multiple apertures and the multiple fixing portions so as to connect the cap with the connection segment of the casing.

3. The door bolt lock structure as claimed in claim 1, wherein the slide plate includes a defining portion formed opposite to the holder.

4. The door bolt lock structure as claimed in claim 1, wherein the second locating orifice is spaced from the first locating orifice.

5. The door bolt lock structure as claimed in claim 1, wherein the casing further includes a stop sheet, and the stop sheet has a through orifice passing through a center of the stop sheet and aligning with the cavity of the casing.

* * * * *